US007377756B2

(12) United States Patent
Hori

(10) Patent No.: US 7,377,756 B2
(45) **Date of Patent: *May 27, 2008**

(54) RAPID EXHAUSTING MECHANISM IN PUMP UNIT

(75) Inventor: Kenichi Hori, Kawasaki (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 372 days.

This patent is subject to a terminal disclaimer.

(21) Appl. No.: 10/999,201

(22) Filed: Nov. 30, 2004

(65) Prior Publication Data

US 2005/0163634 A1 Jul. 28, 2005

(30) Foreign Application Priority Data

Jan. 22, 2004 (JP) ..... P2004-014357

(51) Int. Cl.
*F04B 43/02* (2006.01)
*F04B 17/03* (2006.01)
*F04B 43/04* (2006.01)

(52) U.S. Cl. ..... 417/413.1; 417/440; 417/472; 417/480; 417/559

(58) Field of Classification Search ..... 417/413.1, 417/440, 472, 559, 480
See application file for complete search history.

(56) References Cited

U.S. PATENT DOCUMENTS 4,743,171 A * 5/1988 Mahoney ..... 417/349
4,990,066 A * 2/1991 Kern ..... 417/307
5,220,925 A * 6/1993 Hishida ..... 600/493
5,556,073 A * 9/1996 Wawro et al. ..... 251/129.11
5,647,395 A * 7/1997 Hashimoto et al. ..... 137/517
6,382,928 B1 * 5/2002 Chang ..... 417/269
6,592,339 B1 * 7/2003 Fukushima et al. ..... 417/269
6,783,500 B2 * 8/2004 Dromms et al. ..... 600/490
6,893,233 B2 * 5/2005 Hong ..... 417/569
2005/0047934 A1 * 3/2005 Nawa ..... 417/357
2005/0047940 A1 * 3/2005 Nawa et al. ..... 417/413.1

FOREIGN PATENT DOCUMENTS

JP 2000-352379 12/2000

* cited by examiner

*Primary Examiner*—Anthony D. Stashick
*Assistant Examiner*—Leonard J Weinstein
(74) *Attorney, Agent, or Firm*—Whitham Curtis Christofferson & Cook, P.C.

(57) ABSTRACT

A diaphragm is provided in a pump case so as to define a pump chamber communicated with an external member having an air chamber. A motor actuates the diaphragm to introduce air to the air chamber. An exhaust valve exhausts air in the pump chamber to lower a pressure in the air chamber. In the exhaust valve, an exhaust port is communicated with the pump chamber. A flexible valve body having a larger size than the exhaust port is disposed so as to close the exhaust port from a side facing the pump chamber. An actuator is disposed in an opposite side to the valve body relative to the exhaust port, and driven by the motor so as to be movable between a first position retracted from the exhaust port and a second position passing through the exhaust port so that the valve body is actuated so as to open the exhaust port. An urging member always urges the actuator to the first position thereof.

9 Claims, 3 Drawing Sheets

RAPID EXHAUSTING MECHANISM IN PUMP UNIT

BACKGROUND OF THE INVENTION

The present invention relates to a rapid exhausting mechanism in a pump unit which is suitable for a small-sized sphygmomanometer for measuring blood pressure at a wrist, for example.

Conventionally, a small-sized sphygmomanometer is composed so that, for example, a cuff wound around an upper arm is pressurized to a predetermined pressure level by a small-sized air pump, the pressure in the cuff is gradually lowered at a constant-speed by a normal exhausting mechanism after the blood flow is interrupted once by pressing the artery, patterns of the pressure inside the cuff and vibration amplitude incidental to pulsation of the artery are processed by a microcomputer, and the systolic blood pressure and diastolic blood pressure are measured. The rapid exhausting mechanism is to instantaneously exhaust air in the cuff after the measuring process is over, and it is necessary that no air leaks when carrying out pressurization and measurement.

Generally, it is preferable that characteristics of the normal exhausting mechanism used for a sphygmomanometer reside in a linear decrease in the pressure inside the cuff at a constant speed of 3 mmHg through 4 mmHg per second or so as time elapses and characteristics of the rapid exhausting mechanism reside in a quick descent of the pressure as time elapses.

FIG. 3 shows such a pump unit equipped with respective exhausting mechanism as described above. In the same drawing, the pump unit 1 is composed of a pump section 2 driven by an electric motor, a normal exhausting mechanism 3 for exhausting air at a constant speed through, for example, a slit, a rapid exhausting mechanism 4 driven by a plunger, and a tubular body 5 having flexibility.

The normal exhausting mechanism 3 and rapid exhausting mechanism 4 are provided separately from the pump section 2, and these components are connected by the tubular body 5. The tubular body 5 connects an exhaust port 6 of the pump section 2, the normal exhausting mechanism 3 and rapid exhausting mechanism 4 with each other. In addition, the same tubular body 5 is connected to a cuff (not illustrated) wound around, for example, an upper arm. An air path 8 which communicates with a pump chamber 7 of the pump section 2, normal exhausting mechanism 3, rapid exhausting mechanism 4 and the cuff is formed inside the tubular body 5.

In the pump unit 1 thus constructed, as the pump section 2 is driven, and air is taken from the outside into the pump chamber 7, the air in the pump chamber 7 is sent into a cuff through the air path 8. When the pressure in the cuff is pressurized to a predetermined pressure level, air exhaust in the air path 8 is commenced by the normal exhausting mechanism 3. In synchronization therewith, air of a greater volume than the volume of air exhausted from the normal exhausting mechanism 3 is sent into the cuff from the pump chamber 7.

Also, as the cuff is internally pressurized to a predetermined pressure level, the pump section 2 stops its operation, whereby the pressure inside the cuff is gradually lowered by utilizing normal exhaust of the normal exhausting mechanism 3. At this time, patterns of the pressure inside the cuff and vibration amplitudes incidental to pulsation of the artery are processed by a microcomputer, and the systolic blood pressure and diastolic blood pressure are measured. After the measurement is processed, the air in the cuff is discharged with a breath by the rapid exhausting mechanism 4.

However, in the pump unit 1, the normal exhausting mechanism 3 and rapid exhausting mechanism 4 are provided separately from the pump section 2. Therefore, the pump unit 1 has a number of components, and its structure is also complicated. In addition, since the rapid exhausting mechanism 4 of the pump unit 1 employs an exclusive plunger as an actuator, the mechanism 4 becomes heavy and large-sized, resulting in an increase in production costs.

Japanese Patent Publication No. 2000-352379A proposes a relatively small-sized exhausting mechanism. This configuration includes, as an exhausting mechanism in a diaphragm type pump equipped with an actuator for vertically moving a diaphragm, an intake one-way valve having a valve body which is made of a flexible member and is provided so as to correspond to an intake port, and an exhaust one-way valve having a valve body which is made of a flexible member and is provided so as to correspond to an exhaust port. Here, minute concave and convex irregularities are provided on the surface to which the valve bodies comes in contact with, thereby preventing the valve bodies are adhered thereon. The respective one-way valves can be opened in minute differences in pressure between the upstream side and downstream side.

However, it is ignored air leakage at the position where the minute concave and convex irregularities are provided, which is caused when the upstream side is at a high pressure level.

SUMMARY OF THE INVENTION

It is therefore an object of the invention to provide a small-sized and inexpensive pump unit capable of air leakage even at a high pressure level.

In order to achieve the above object, according to the invention, there is provided a pump, comprising:

a pump case;

a diaphragm, provided in the pump case so as to define a pump chamber communicated with an external member having an air chamber;

a motor, which actuates the diaphragm to introduce air to the air chamber; and an exhaust valve, which exhausts air in the pump chamber to lower a pressure in the air chamber, the exhaust valve comprising:

an exhaust port, communicated with the pump chamber;

a flexible valve body, having a larger size than the exhaust port and disposed so as to close the exhaust port from a side facing the pump chamber;

an actuator, disposed in an opposite side to the valve body relative to the exhaust port, and driven by the motor so as to be movable between a first position retracted from the exhaust port and a second position passing through the exhaust port so that the valve body is actuated so as to open the exhaust port; and an urging member, which always urges the actuator to the first position thereof.

With this configuration, when the pressure in the pump chamber is increased, the flexible valve body is pressed against the exhaust port and seals the same. Accordingly, air leaking in such a condition can be reliably avoided while the closing operation of the exhaust port is performed. When the motor drives the actuator so as to move to the second position thereof, the valve body is actuated so that the exhaust port is forcibly opened against the pressure. As a result, the air in the pump chamber is exhausted.

Further, since the actuator is driven by utilizing the driving force of the motor, it is not necessary to adopt the exclusive plunger having large size and weight. Therefore, a small-sized and inexpensive pump can be obtained.

Preferably, the pump further comprises:

a first gear, coupled with a rotary shaft of the motor;

a second gear, meshing with the first gear to be rotated;

a lever member, pivotably provided about the rotary shaft; and a clutch mechanism, connecting the second gear and the lever member such that the lever member is pivoted in accordance with the rotation of the rotary shaft.

Here, the lever member is so pivoted as to come into contact with the actuator such that the actuator is moved to the second position thereof against the urging force from the urging member, when the rotary shaft is rotated in the first direction. The lever member is so pivoted as to separate from the actuator in such a direction that the actuator is placed in the second position when the rotary shaft is rotated in the second direction.

In this case, the actuator is appropriately driven with the small-sized mechanism.

Preferably, each of the actuator, the first gear, the second gear and the lever member is comprised of a resin material.

In this case, the parts cost can be further reduced.

According to the invention, there is also provided a hemodynamometer, comprising:

a cuff, adapted to be attached on a patient body and having an air chamber; and a pump, comprising:

a pump case;

a diaphragm, provided in the pump case so as to define a pump chamber communicated with the air chamber;

a motor, which actuates the diaphragm to introduce air to the air chamber; and an exhaust valve, which exhausts air in the pump chamber to lower a pressure in the air chamber, the exhaust valve comprising:

an exhaust port, communicated with the pump chamber;

a flexible valve body, having a larger size than the exhaust port and disposed so as to close the exhaust port from a side facing the pump chamber;

an actuator, disposed in an opposite side to the valve body relative to the exhaust port, and driven by the motor so as to be movable between a first position retracted from the exhaust port and a second position passing through the exhaust port so that the valve body is actuated so as to open the exhaust port; and an urging member, which always urges the actuator to the first position thereof.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

One embodiment of the invention will be described below in detail with reference to the accompanying drawings. A pump unit according to this embodiment is suitable for a small-sized sphygmomanometer for measuring blood pressure at a wrist.

Figure 1:
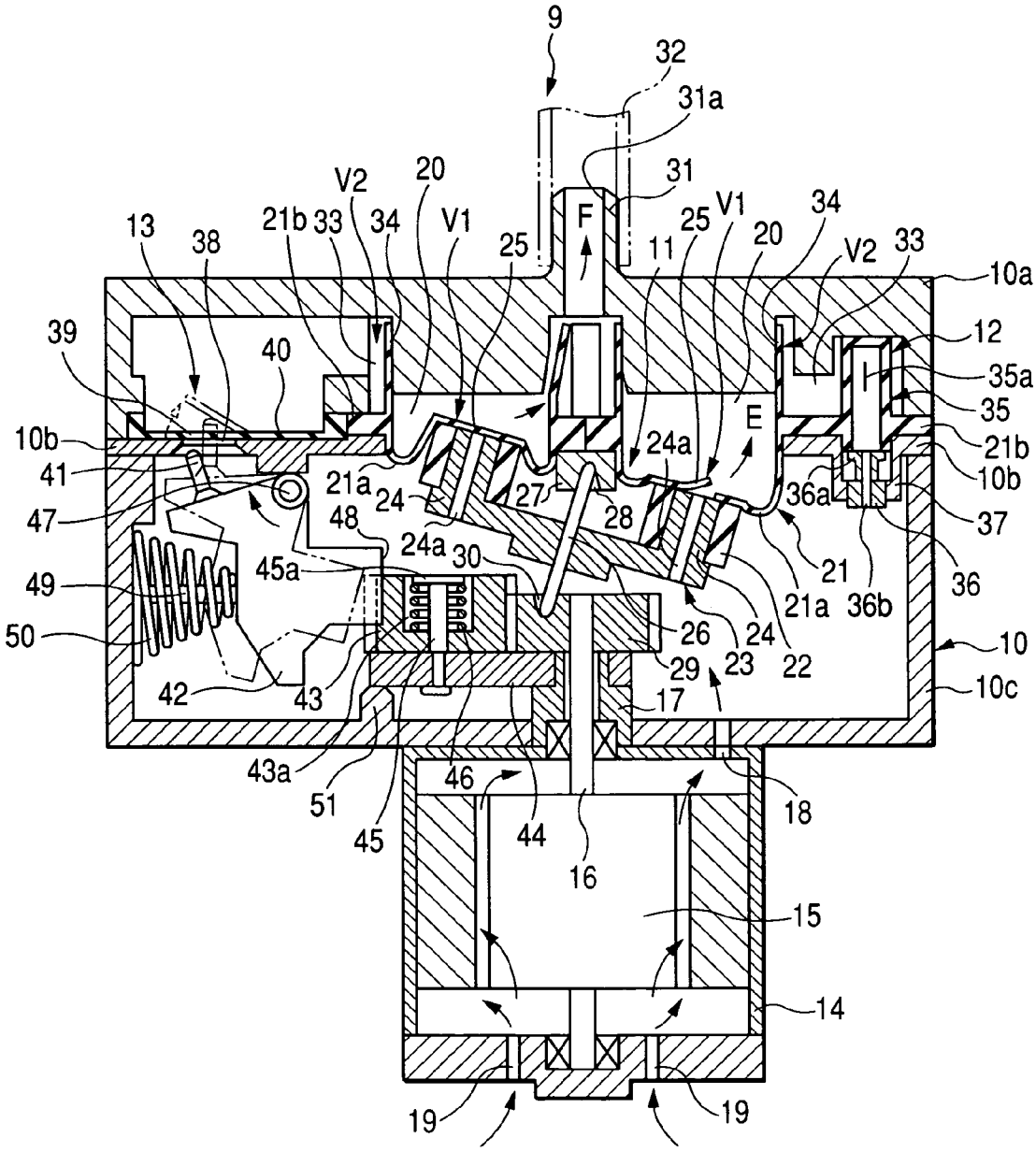
FIG. 1 is a vertical section view of a pump unit according to one embodiment of the invention.

As shown in FIG. 1, a pump unit 9 is composed so that a pump section 11, a normal exhausting mechanism 12 and a rapid exhausting mechanism 13, which are the major parts of the pump unit 9, are provided internally in a unit case 10, made of a resin material, which is rectangular in its plan view and is composed of an upper case 10*a*, an intermediate plate 10*b* and a lower case 10*c*. A motor case 14 is fixed on and attached to the lower face of the unit case 10, and a motor 15 for driving members in the pump section 11 is accommodated in the motor case 14. The rotary drive shaft 16 of the motor 15 protrudes into the lower case 10*c* along with its bearing portion 17. A communication opening 18 is provided between the lower case 10*c* and the motor case 14. Here, intake ports 19 are provided on the lower part of the motor case 14 in order to take atmospheric air into the motor case 14.

A description is given of the principal mechanism of the pump unit 9 on the basis of the structure of the pump section 11. The pump section 11 is equipped at an intermediate portion between the normal exhausting mechanism 12 and the rapid exhausting mechanism 13, and is provided with a diaphragm body 21 having two diaphragm portions 21*a* which form pump chambers 20. The diaphragm body 21 is composed of a member having flexibility such as a rubber material having resiliency or a flexible plastic material, and flange portions 21*b* are placed and fixed between the upper case 10*a* and the intermediate plate 10*b* and are held at the unit case 10. Hollowed bodies 22 are provided so as to protrude from the lower part center portion of the respective diaphragm portions 21*a* in the diaphragm body 21, and a rocking body 23 for vertically rocking the lower face of the respective diaphragm portions 21*a* is provided downward of the diaphragm body 21.

Axial bodies 24 which are located in the vicinity of both end parts of the rocking body 23 and downward of the center part of the respective diaphragm portions 21*a* and has air intake ports 24*a* protruding upward. And, the inner faces of the respective hollowed bodies 22 are firmly adhered to the outer faces of the respective axial bodies 24, and the respective diaphragm portions 21*a* are attached to the rocking body 23. Portions corresponding to the air intake ports 24*a* on the bottom portion of the respective diaphragm portions 21*a* are partially cut off, wherein valve bodies 25 are formed, and the respective air intake ports 24*a* can be closed and opened by the valve bodies 25, thereby forming valve sections V1.

An eccentric rotary shaft 26 for rocking the rocking body 23 by its eccentric rotation is passed through and fixed at the center part of the rocking body 23. A protrusion 27 protruded from the intermediate plate 10*b* is provided upward of the rocking body 23, and a recess 28 is formed at the lower part of the protrusion 27. On the other hand, a drive gear 29 made of a resin material is fixed at and attached to the upper end of the rotary shaft 16 protruding from downward into the lower case 10*c*, and a recess 30 is formed at a position apart from the center position of the upper part of the drive gear 29. And, the upper end of the eccentric rotary shaft 26 is idly fitted in the recess 28, and the lower end thereof is idly fitted in the recess 30.

In addition, a nozzle 31 is provided so as to protrude from the central part of the upper face of the upper case 10*a* and an exhaust port 31*a* is drilled and provided at the nozzle 31. A tubular body 32 having flexibility, which communicates to a cuff (not illustrated), is firmly fitted to and connected to the nozzle 31. On the other hand, two annular grooves 33 are formed so as to face downward, which communicate with the exhaust port 31*a*, are formed on the outer circumference of the exhaust port 31*a* on the lower face of the upper case 10*a*, and exhaust valve bodies 34 extending from the respective diaphragm portions 21*a* are pressed to the inner wall face forming the annular grooves 33, wherein exhaust valve portions V2 are composed.

Next, a description is given of a structure of the normal exhausting mechanism. The normal exhausting mechanism 12 is provided so as to correspond to the annular grooves 33 communicating with the inside of a cuff through the exhaust port 31*a*, and is provided with a valve body 35 formed at a part of the diaphragm body 21 and an adjuster 36 with a screw, which adjusts the exhaust quantity of the valve body 35. The adjuster 36 is screwed in a screw hole of a hollow cylindrical portion 37 of the intermediate plate 10*b*.

The valve body 35 causes a part of the diaphragm body 21 to protrude upward in the annular groove 33, and the upper end thereof is formed to be like a closed tube. The valve body 35 is brought into contact with the inside lower face of the annular groove 33, and a slit 35 communicating with the inside is formed on the circumference of the valve body 35 along the lengthwise direction (the vertical direction in FIG. 1) thereof.

On the other hand, a press member 36*a* having a greater outer diameter than the inner diameter of the lower end opening of the valve body 35 is formed at the tip end of the adjuster 36 with a screw to become integral therewith, and an engagement groove (not illustrated) into which the tip end of a screwdriver is inserted when adjusting the exhaust quantity is formed at the base end side of the adjuster 36 with a screw. In addition, a through hole 36*b* passed through the both ends of the adjuster 36 is opened and provided at the center part of the adjuster 36 with a screw. The adjuster 36 with a screw is caused to move upward, that is, in the direction along which the adjuster 36 is penetrated into the valve body 35, by engaging the tip end of a screwdriver with the engagement groove and turning it in the right direction, and move downward, that is, in the direction along which the adjuster 36 comes out of the valve body 35, by turning the same in the left direction.

In the normal exhausting mechanism 12, if the adjuster 36 with a screw is turned in the right direction and is moved to the valve body 35 side, the press member 36*a* is inserted into the valve body 35. By insertion thereof, the valve body 35 is pressed and widened to be deformed, and in line with the deformation, the slit 35*a* is opened. Air passed through the opening of the slit 35*a* passes through the through hole 36*b* of the adjuster 36 with a screw and is exhausted therefrom. The opening amount of the slit 35*a* can be adjusted by the amount of deformation of the valve body 35 in accordance with the amount of movement of the adjuster 35 with the screw, so that the rate of gradually reducing the pressure inside the cuff can be adjusted. The adjustment is carried out when assembling. Usually, the adjustment is not executed after the assembling, excepting the cases of maintenance and inspection.

Next, a description is given of a structure of the rapid exhausting mechanism 13. The rapid exhausting mechanism 13 has an exhaust port 38 drilled at the part of the intermediate plate 10*b*, which lets air in the cuff escape. A valve body 39 having a greater area than the area of the opening of the exhaust port 38 is disposed at a high pressure side communicating with the inside of the cuff via the annular groove 33. The valve body 39 is formed by using a thin rubber sheet 40 having easy deformability such as chloroprene and silicone, etc., and cutting in the same to become almost semi-circular.

The valve body 39 includes an exhaust lever 42 having an exhaust pin 41 which presses and opens the valve body 39 from the rear side through the exhaust port 38 and a lever driving gear 43, made of a resin material, for driving the exhaust lever 42. The lever driving gear 43 is rotatably attached to the other end side of the pivot lever 44, made of a resin material, one end side of which is pivotably attached to the bearing portion 17, via a pivot shaft 45 and a coil spring 46 serving as a clutch, and is engaged with the drive gear 29.

The Z-shaped exhaust lever 42 is formed by a resin material having an adequate thickness. The exhaust pin 41 is provided so as to protrude from one end portion of the upper face opposed to the exhaust port 38, and a hinge 47 is provided at the other end portion of the upper face. The exhaust lever 42 is provided at the lower case 10*c* so as to be pivotable about the hinge 47. The exhaust lever 42 pivots between an opening position where the exhaust pin 41 presses and opens the valve body 39 and a closing position where the exhaust pin 41 is retracted from the exhaust port 38.

Figure 2:
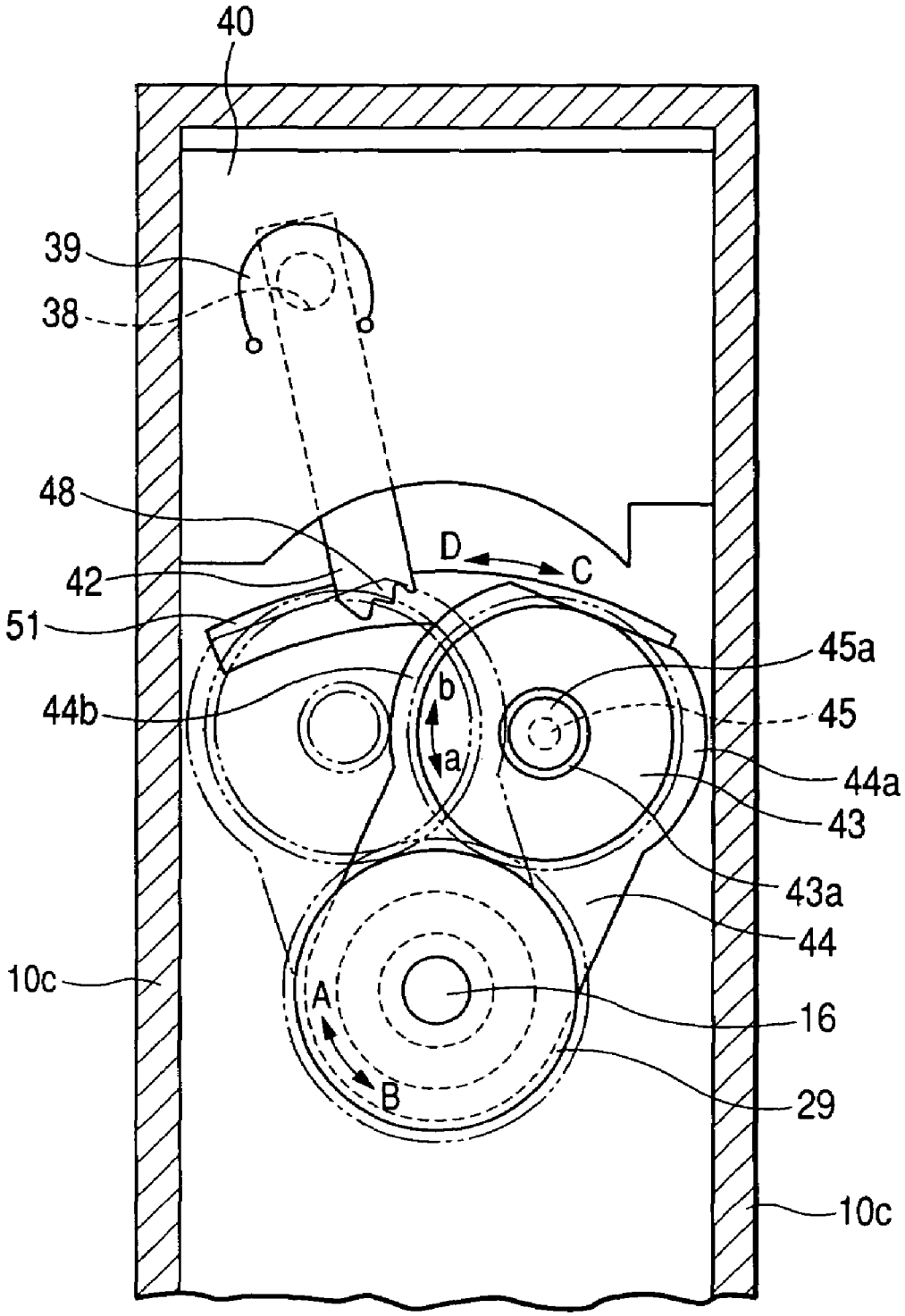
FIG. 2 is an enlarged plan view of a rapid exhausting mechanism in the pump unit of FIG. 1.
Figure 3:
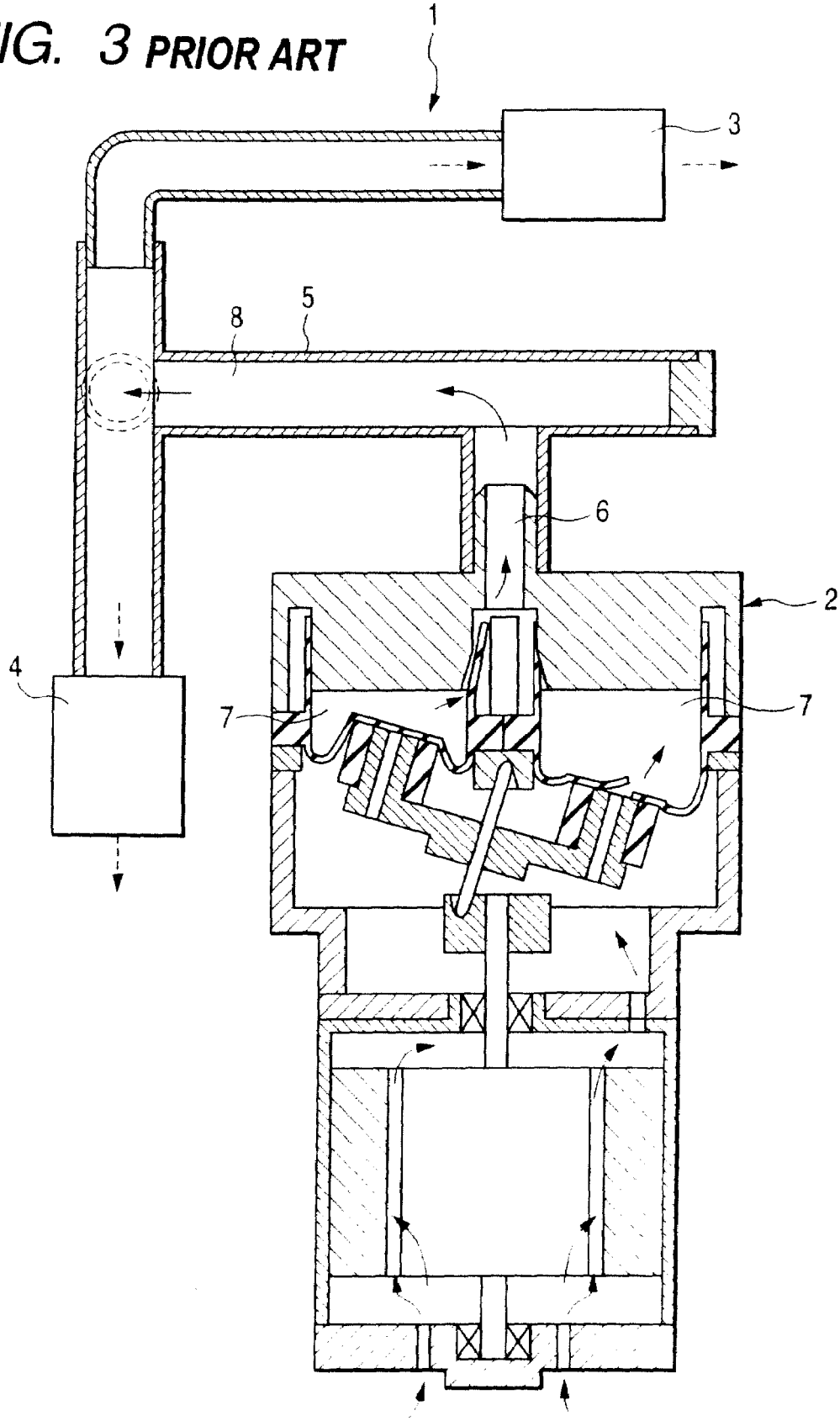
FIG. 3 PRIOR ART
FIG. 3 is a vertical section view of a related-art pump unit.

Further, an engaging section 48 having a plurality of teeth (three teeth in FIG. 2) is formed at the portion corresponding to the lever driving gear 43 at the lower side in the exhaust lever 42. As shown in FIG. 2, the plurality of teeth are formed to be engaged with the gear teeth of the driving gear 43. A retainer pin 49 is provided so as to protrude from the side of the exhaust lever 42 which is opposite to the side of the engaging section 48, and a conical coil spring 50 fixed on the retainer pin 49 is disposed between the exhaust lever 42 and the inner wall face of the lower case 10*c* while being compressed. The exhaust lever 42 is always pressed to the closing position by resiliency of the conical coil spring 50.

As described above, the lever driving gear 43 is rotatably attached to the other end portion of the pivot lever 44, one end portion of which is pivotably attached to the bearing portion 17, via a pivot shaft 45 and a coil spring 46 serving as a clutch. Both sides at the other end portion at the pivot lever 44 are slightly swelled. By both the swelled portions 44*a* and 44*b* being brought into contact with the walls at the lower case 10, the pivot lever 44 is regulated in terms of its pivot amount in the left and right directions in FIG. 2. In addition, an arcuate guide rib 51 for guiding the tip end portion of the pivot lever 44 is provided on the bottom face of the lower case 10*c*.

A flat head portion 45*a* which is flush with the upper face of the lever driving gear 43 is formed on the top portion of the pivot shaft 45 for rotatably supporting the lever driving gear 43. Further, a recess 43*a* is provided at the middle part of the upper face of the lever driving gear 43. The coil spring 46 is pressed and provided between the flat head portion 45*a* and the recess 43*a*, wherein the lower face of the lever driving gear 43 is brought into press contact with the upper face of the pivot lever 44 by resiliency of the coil spring 46.

The lever driving gear 43 rotatably attached to the pivot shaft 45 on the pivot lever 44 is engaged with the drive gear 29 fixed on the rotary drive shaft 16. When the motor 15 is driven and the drive gear 29 is rotated, the lever driving gear 43 is rotated integrally with the drive gear 29.

Next, a description is given of operations of the pump unit 9 equipped with a rapid exhausting mechanism as described above. When the motor 15 is driven for rotation in its normal direction and the drive gear 29 is rotated by rotation of the rotary drive shaft 16, the eccentric rotary shaft 26 eccentrically turns in the pump section 11, wherein the rocking body 23 is caused to rock, and the lower end portions of the respective diaphragm portions 21*a* of the diaphragm body 21 move vertically. When the lower end portion of one diaphragm portion 21*a* is moved downward, the pressure in the interior of the diaphragm portion 21*a* is made negative, and the exhaust valve body 34 which adheres to the inner wall face of the annular groove 33 closes the exhaust valve portion V2 and the valve body 25 opens the air intake port 24*a* from its closed state, thereby making the valve portion V1 open, wherein air intake is carried out from the air intake port 24*a* into the diaphragm portion 21*a* as shown by the arrow E.

On the other hand, in the rapid exhausting mechanism, if the drive gear 29 normally rotates (in the direction of the arrow A in FIG. 2) by rotation of the motor 15 in its normal direction, the lever driving gear 43 rotates in its normal direction (in the direction of the arrow a in FIG. 2). At this time, since clutch friction is produced due to resiliency of the coil spring 46 between the lever driving gear 43 and the pivot lever 44, the pivot lever 44 turns in the direction of the arrow C in FIG. 2 about the bearing portion 17 until the swelled portion 44*a* is brought into contact with the right inner wall of the lower case 10*c* in FIG. 2. When, with the contacting, the pivot lever 44 is regulated in terms of its turning, a portion (clutch portion) which is friction-coupled as a clutch between the pivot lever 44 and the swelled portion 44*a* slides, and only the lever driving gear 43 keeps idly rotating along with the drive gear 29.

Thus, when the motor 15 normally rotates, the lever driving gear 43 is apart from the engaging section 48 of the exhaust lever 42. Therefore, the exhaust lever 42 is subjected to a rotating force in the counterclockwise direction in FIG. 1 due to resiliency of the conical coil spring 50, wherein the exhaust lever 42 is moved to the closing position, and the rapid exhausting mechanism 13 is brought into an inoperable state. In this situation, the valve body 39 having a greater area than the area of the opening of the exhaust port 38 is pressed to the portion of the intermediate plate 10*b* in the periphery of the exhaust port 38 by the pressure and is deformed so as to follow the profile of the exhaust port 38 and is adhered thereto. Therefore, a closing action of the exhaust port 38 is carried out by the valve body 39, so that no air leaks even at a high pressure level.

Next, when the lower end portion of the diaphragm portion 21*a* is vertically moved in the pump 11, the interior of the diaphragm portion 21*a* is made into high pressure, and the valve body 25 closes the air intake port 24*a* to cause the valve portion V1 to be closed, and at the same time, the exhaust valve body 34 is made wider than the inner wall face of the annular groove 33, so that air is exhausted by the exhaust valve portion V2 as shown by the arrow F. Air exhausted from the exhaust valve body 34 is exhausted through the tubular body 32 from the exhaust port 31*a* communicating with the annular groove 33 and is sent to the cuff side wound around a wrist.

When the inside of the cuff is pressurized to a determined pressure level, air in the air paths is exhausted by the normal exhausting mechanism 12, and in line therewith, air of a greater amount than the exhaust amount by the normal exhausting mechanism 12 is further sent into the cuff. Also, when the inside of the cuff is pressurized to a predetermined pressure level, the motor 15 comes to a stop. That is, the pump action stops. Thereby, air in the air path is gradually allowed to escape by using the normal exhausting mechanism 12. Accordingly, the pressure in the cuff is gradually lowered. At this time, patterns of the inside pressure in the cuff and vibration amplitudes in line with pulsation of the artery are processed by a microcomputer, and the systolic blood pressure and diastolic blood pressure are measured.

When the motor 15 is rotated inversely after the blood measurement is processed, the drive gear 29 is inverted rotatably (in the direction of the arrow B in FIG. 2) in the rapid exhausting mechanism 13, and the lever driving gear 43 is inverted rotatably (in direction of the arrow b in FIG. 2). At this time, since clutch friction is produced by resiliency of the coil spring 46 between the lever driving gear 43 and the pivot lever 44, the pivot lever 44 is pivoted in the direction of the arrow D in FIG. 2 about the bearing portion 17. If the lever driving gear 43 is rotated by a predetermined amount in line with rotation of the pivot lever 44, the lever driving gear 43 engages with the engaging section 48 of the exhaust lever 42 during the pivot motion. If the lever driving gear 43 is further rotated, a force of pressing the engaging section 48 from the lever driving gear 43 side to the outside, that is, a rotating force in the clockwise direction in FIG. 1 is applied to the engaging section 48, whereby the exhaust lever 42 is pivoted about the hinge 47 from the closing position to the opening position, the valve body 39 is pressed and opened by the exhaust pin 41 and the air in the cuff is forcibly exhausted. Thereafter, the pivot lever 44 is pivoted until the swelled portion 44*b* is brought into contact with the left inner wall of the lower case 10*c* in FIG. 2. In this situation, a portion which is friction-coupled as a clutch between the pivot lever 44 and the swelled portion 44*b* slides, and only the lever driving gear 43 idly rotates along with the drive gear 29 until the motor 15 stops driving.

As described above, in the rapid exhausting mechanism 13 according to the present embodiment, when the inside of the cuff wound around a wrist is pressurized by the pump section 11 and when the blood pressure is measured after the inside of the cuff is pressurized to a predetermined pressure level, the valve body 39, made of a thin rubber sheet 40, which has a greater area than the opening area of the exhaust port 38 and has easy deformability is pressed to the intermediate plate 10*b* portion in the periphery of the exhaust port 38, and at the same time, is deformed and adhered thereto so as to follow the shape of the exhaust port 38, whereby it is possible to reduce the air leakage even at a high pressure level.

In addition, component members made of resin materials, which are easy to be manufactured and are relatively inexpensive, such as the intermediate plate 10*b*, the exhaust lever 42, the pivot lever 44, the drive gear 29 and the lever driving gear 43 are assembled in the unit case 10, and the drive source does not employ any expensive, heavy, and large-sized plunger, which has been conventionally employed, wherein by utilizing a drive force of a motor 15 for driving the pump section 11, it is possible to provide a small-sized and inexpensive rapid exhausting mechanism.

Further, the spring 46 serving as a clutch between the lever driving gear 49 and the pivot lever 44 is accommodated in the lever driving gear 43, wherein the lever driving gear 43 equipped with a clutch feature can be made compact.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A pump, comprising:

a pump case;

a diaphragm, provided in the pump case so as to define a pump chamber communicated with an external member having an air chamber;

a motor, which actuates the diaphragm to introduce air to the air chamber; and an exhaust valve, which exhausts air in the pump chamber to lower a pressure in the air chamber, the exhaust valve comprising:

an exhaust port, communicated with the pump chamber;

a flexible valve body, having a larger size than the exhaust port and disposed so as to close the exhaust port from a side facing the pump chamber;

an actuator, disposed in an opposite side to the flexible valve body relative to the exhaust port, and driven by the motor so as to be movable between a first position retracted from the exhaust port and a second position passing through the exhaust port so that the flexible valve body is actuated so as to open the exhaust port; and an urging member, which always urges the actuator to the first position thereof.

2. The pump as set forth in claim 1, further comprising:

a first gear, coupled with a rotary shaft of the motor;

a second gear, meshing with the first gear to be rotated;

a lever member, pivotably provided about the rotary shaft; and a clutch mechanism, connecting the second gear and the lever member such that the lever member is pivoted in accordance with the rotation of the rotary shaft, wherein:

the lever member is so pivoted as to come into contact with the actuator such that the actuator is moved to the second position thereof against the urging force from the urging member, when the rotary shaft is rotated in a first direction; and the lever member is so pivoted as to separate from the actuator such that the actuator is moved to the first position when the rotary shaft is rotated in a second direction.

3. The pump as set forth in claim 1, wherein the actuator is comprised of a resin material.

4. The pump as set forth in claim 2, wherein each of the first gear, the second gear and the lever member is comprised of a resin material.

5. The pump of claim 1, wherein said flexible body is disposed on a high pressure side of said exhaust port.

6. The pump of claim 1, wherein said flexible body is made of a rubber.

7. A hemodynamometer, comprising:

a cuff, adapted to be attached on a patient body and having an air chamber; and a pump, comprising:

a pump case;

a diaphragm, provided in the pump case so as to define a pump chamber communicated with the air chamber;

a motor, which actuates the diaphragm to introduce air to the air chamber; and an exhaust valve, which exhausts air in the pump chamber to lower a pressure in the air chamber, the exhaust valve comprising:

an exhaust port, communicated with the pump chamber;

a flexible valve body, having a larger size than the exhaust port and disposed so as to close the exhaust port from a side facing the pump chamber;

an actuator, disposed in an opposite side to the flexible valve body relative to the exhaust port, and driven by the motor so as to be movable between a first position retracted from the exhaust port and a second position passing through the exhaust port so that the flexible valve body is actuated so as to open the exhaust port; and an urging member, which always urges the actuator to the first position thereof.

8. The hemodyamometer of claim 7, wherein said flexible body is disposed on a high pressure side of said exhaust port.

9. The hemodyamometer of claim 7, wherein said flexible body is made of a rubber.

* * * * *